US006164871A

United States Patent [19]

Kennedy et al.

[11] Patent Number: 6,164,871

[45] Date of Patent: Dec. 26, 2000

[54] MINE STOPPING HAVING A SWINGING DOOR

[75] Inventors: William R. Kennedy; John M. Kennedy, both of Taylorville, Ill.

[73] Assignee: Jack Kennedy Metal Products & Buildings, Inc., Taylorville, Ill.

[21] Appl. No.: 09/188,918

[22] Filed: Nov. 9, 1998

[51] Int. Cl.[7] ..... E21D 11/00; E21F 1/14

[52] U.S. Cl. ..... 405/152; 405/151; 49/501; 454/169

[58] Field of Search ..... 405/132, 151, 405/152; 454/168, 169, 170; 49/465, 501

[56] References Cited

U.S. PATENT DOCUMENTS

| | | | |
|---|---|---|---|
| Re. 34,053 | 9/1992 | Kennedy et al. | 405/132 |
| 283,286 | 8/1883 | Sawyer | 454/168 |
| 1,478,303 | 12/1923 | Snyder | 454/168 |
| 2,188,694 | 1/1940 | Tucker | 454/168 |
| 2,621,725 | 12/1952 | Shacikoski | 160/40 |
| 2,729,064 | 1/1956 | Kennedy et al. | 61/45 |
| 3,118,363 | 1/1964 | Burgess, Jr. | 98/50 |
| 3,303,343 | 2/1967 | Bear | 454/168 |
| 3,690,299 | 9/1972 | Johnson | 119/1 |
| 3,906,670 | 9/1975 | Burton | 49/381 |
| 3,977,312 | 8/1976 | Kissell | 98/50 |
| 4,009,649 | 3/1977 | Thimons et al. | 98/50 |
| 4,023,372 | 5/1977 | Presler et al. | 61/403 |
| 4,036,024 | 7/1977 | Dreker et al. | 61/42 |
| 4,043,079 | 8/1977 | Smith | 49/349 |
| 4,096,702 | 6/1978 | Burton | 405/132 |
| 4,388,779 | 6/1983 | Peterson | 49/253 |
| 4,478,535 | 10/1984 | Kennedy et al. | 405/132 |
| 4,523,406 | 6/1985 | Kennedy et al. | 405/132 |
| 4,754,797 | 7/1988 | Sronce | 160/354 |
| 4,820,081 | 4/1989 | Kennedy et al. | 405/132 |
| 5,167,474 | 12/1992 | Kennedy et al. | 405/132 |
| 5,240,349 | 8/1993 | Kennedy et al. | 405/132 |
| 5,466,187 | 11/1995 | Kennedy et al. | 454/169 |

FOREIGN PATENT DOCUMENTS

| | | |
|---|---|---|
| 1451615 | 10/1976 | United Kingdom . |
| 1580537 | 12/1980 | United Kingdom . |

OTHER PUBLICATIONS

PCT International Application, publication date Sep. 24, 1998 WO 98/41733.

*Primary Examiner*—Eileen D. Lillis
*Assistant Examiner*—Gary S. Harsmann
*Attorney, Agent, or Firm*—Senniger, Powers, Leavitt & Roedel

[57] ABSTRACT

A mine stopping comprising a wall extending across a passageway in a mine to close the passageway. The wall has an opening therein. A door is hinged adjacent the opening for swinging between a closed position in which the door closes the opening to inhibit the passage of air therethrough, a first open position in which the door is moved in one direction away from the closed position, and a second open position in which the door is swung in an opposite direction away from the closed position. The door is movable to either of the first and second open positions when the door is subjected to substantial concussive air pressure thereby to permit concussive air to pass through the opening in both directions.

12 Claims, 6 Drawing Sheets

MINE STOPPING HAVING A SWINGING DOOR

BACKGROUND OF THE INVENTION

This invention relates generally to mine ventilation and, more particularly, to mine doors and mine stoppings.

So-called "stoppings" are widely used in mines to stop off the flow of air in passageways in the mines, a "stopping" generally being a masonry (e.g., concrete block) or metal wall installed at the entrance of a passageway to block flow of air therethrough. Such stoppings are typically provided with a doorway or opening and a door therein for occasional access to the blocked-off passageway. This arrangement is satisfactory under usual conditions when the stopping should prevent the passage of air through the passageway. In some conditions, however, high pressure concussive air is forced against the stopping and door. This may occur, for instance, in longwall mining where a large roof can collapse very rapidly and displace a large amount of air, thereby creating a shock wave of high pressure concussive air. Likewise, a mine blast will also force high pressure concussive air against the stopping and the door. In conventional stopping arrangements, the concussive air cannot escape through the stopping without causing significant damage to the stopping, the door or both.

Moreover, prior art stoppings are constructed generally perpendicular to the direction of air flow through the passageway. This construction is not optimal for decreasing the stress on the stopping caused by the concussive air.

SUMMARY OF THE INVENTION

Among the several objects and features of the present invention may be noted the provision of an improved mine stopping having a door which seals an opening in the stopping; the provision of such a stopping wherein the door can swing open in either of two directions to avoid damage to the stopping due, for example, to concussive air generated by longwall mining or by a mine blast; and the provision of such a stopping which is effective in controlling mine ventilation.

Further among the several objects and features of the present invention may be noted the provision of a mine stopping which may be installed in a mine passageway so as to reduce dynamic air pressure exerted on the stopping; the provision of such a mine stopping which is less likely to be damaged by concussive air; and the provision of such a mine stopping which is effective in controlling mine ventilation and which is economical to manufacture.

Briefly, this invention is directed to a mine stopping comprising a wall extending across a passageway in a mine to close the passageway. The wall has an opening therein. A door is hinged adjacent the opening for swinging between a closed position in which the door closes the opening to inhibit the passage of air therethrough, a first open position in which the door is swung in one direction away from the closed position, and a second open position in which the door is swung in an opposite direction away from the closed position. The door is movable to either of the first and second open positions when the door is subjected to substantial concussive air pressure thereby to permit concussive air to pass through the opening in both directions.

In another aspect of the invention, a swinging door system for closing an opening in a mine stopping comprises a door hinged adjacent the opening for swinging between a closed position in which the door closes the opening to inhibit the passage of air therethrough, a first open position in which the door is swung in one direction away from the closed position, and a second open position in which the door is swung in an opposite direction away from the closed position. The door is movable to either of the first and second open positions when subjected to substantial concussive air pressure thereby to permit concussive air to pass through the opening in both directions.

In yet another aspect of the present invention, a mine stopping is installed in a mine passageway having air flowing through the passageway in a first direction. The mine stopping comprises a rigid wall extending across the passageway to close it, and an opening in the wall to permit the passage of air therethrough for regulating the airflow. The wall extends between the opening and one side of the passageway at an oblique angle with respect to the direction of air flow through the passageway whereby air flowing through the passageway strikes the wall at the oblique angle thereby to reduce the dynamic air pressure exerted on the wall.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
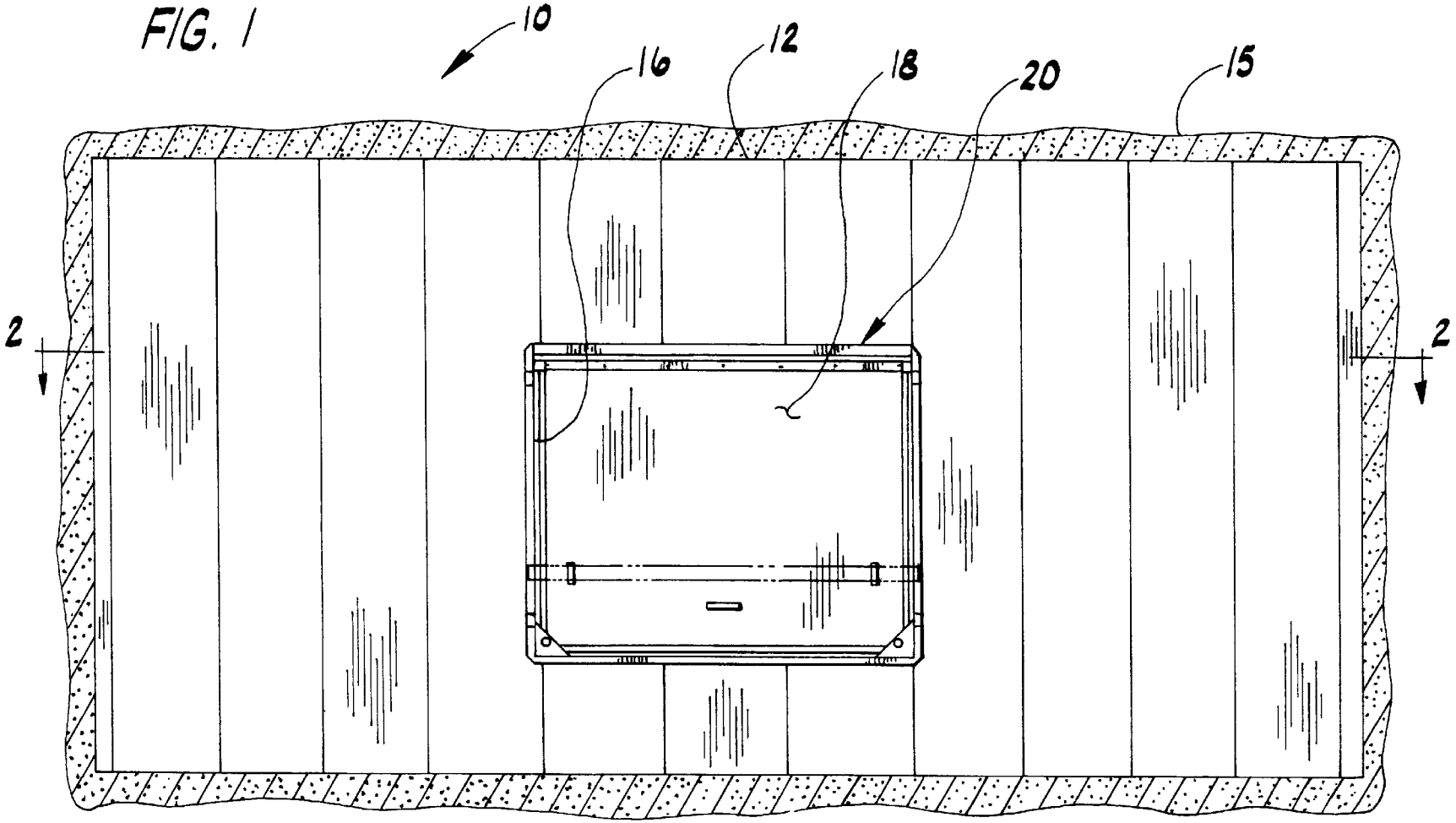
FIG. 1 is a front elevation of a mine stopping of the present invention having a swinging door mounted thereon.
Figure 2:
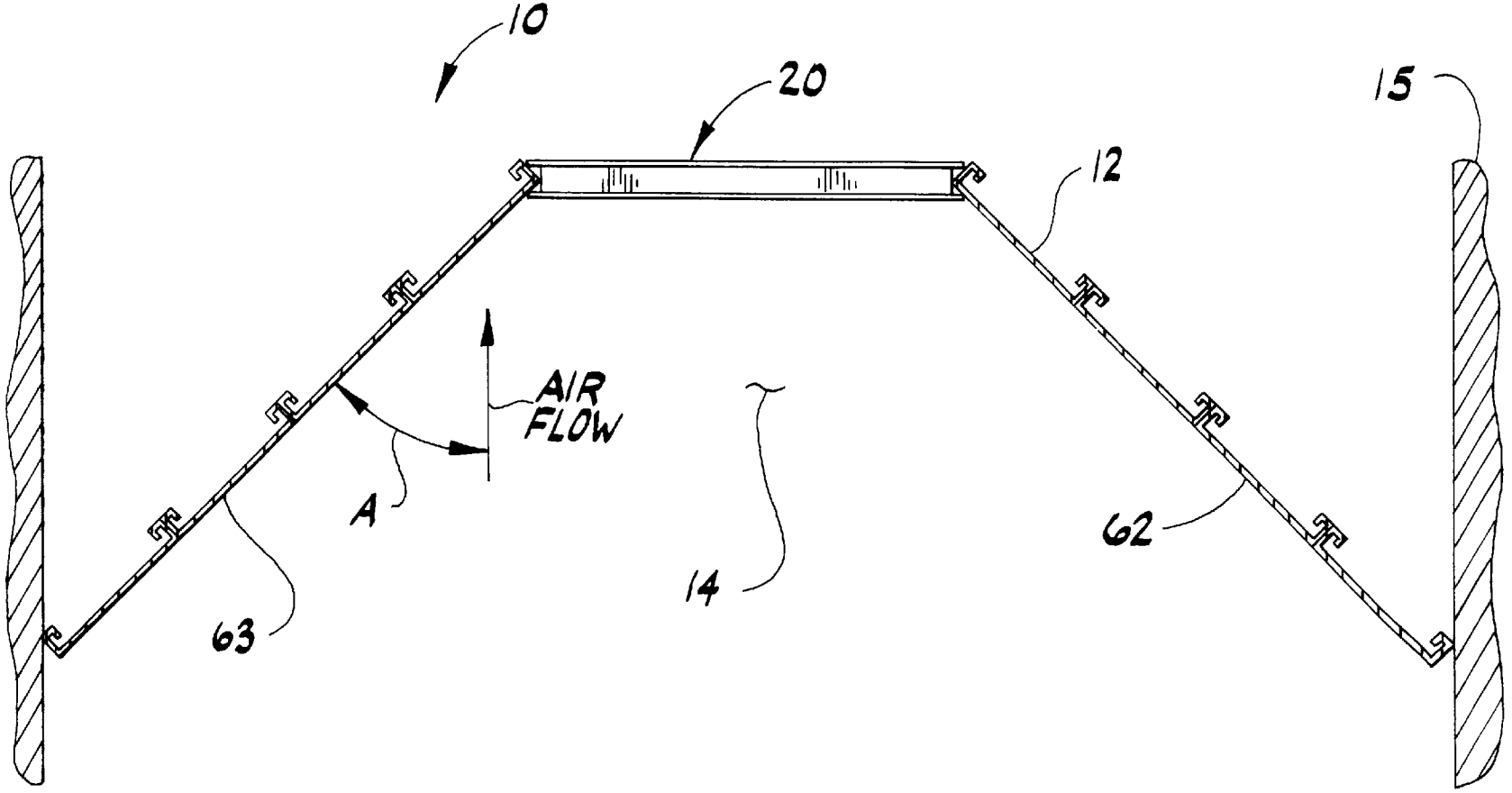
FIG. 2 is a horizontal cross section taken in the plane of line 2—2 of FIG. 1.

Referring now to the drawings, FIGS. 1–5 show a sloped mine stopping, generally designated 10, having a rigid wall 12 extending across a passageway 14 in a mine 15 to close the passageway, an opening 16 in the wall, and a swinging door 18 for closing the opening. The opening 16 is preferably defined by a rectangular door frame, generally designated 20. The door 18 is hinged adjacent the opening 16, the door preferably being hinged on the door frame 20. However, it is contemplated that the door may be hinged directly on the wall 12. The door frame 20 has opposing top and bottom horizontal frame members, designated 22 and 23, respectively, and two opposing vertical right and left side frame members, designated 24 and 25, respectively. The horizontal and vertical frame members 22–25 may be formed from channel bar stock, for example. The door 18 includes a main panel portion 28, a face which defines a plane P, preferably formed from steel plate and reinforcing box beams 29 extending along its bottom and vertical sides. The door also includes an upper portion 30 preferably formed by a separate steel strip secured, such as by welding, to the main portion. The upper portion 30 is shaped to form a sleeve 32 extending parallel to the top edge of the door for receiving a horizontal hinge pin 34 which is secured to the top frame member 22. The door 18 is swingable on the hinge pin 34 relative to the frame 20 between a closed position (FIG. 4) engaging inwardly facing surfaces 35 of the frame members 22–25 to inhibit the flow of air through the opening, a first open position in which the door is swung in one direction away from its closed position (FIG. 5), and a second open position in which the door is swung in an opposite direction away from its closed position (shown in phantom lines in FIG. 5). It is to be understood that other hinge configurations for the door 18 may be used within the scope of this invention. For instance, while the door 18 is preferably hinged along its top edge, it will be understood that the door may be hinged at its bottom or at one side.

Figure 4:
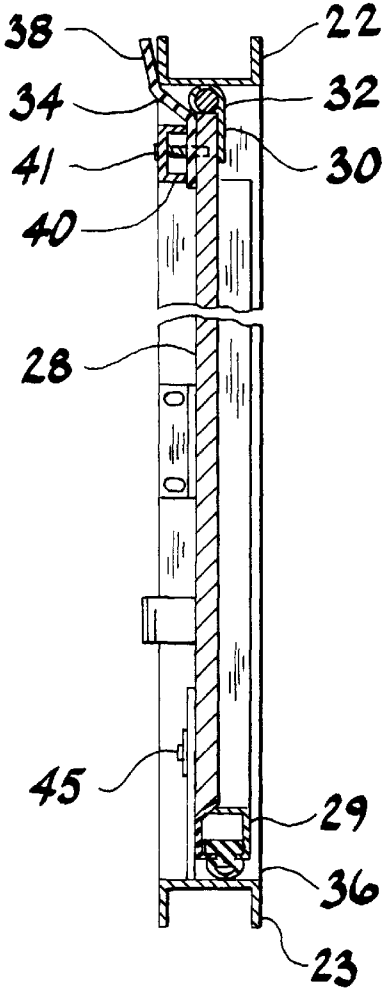
FIG. 4 is an enlarged vertical cross section taken in the plane of line 4—4 of FIG. 3.
Figure 3:
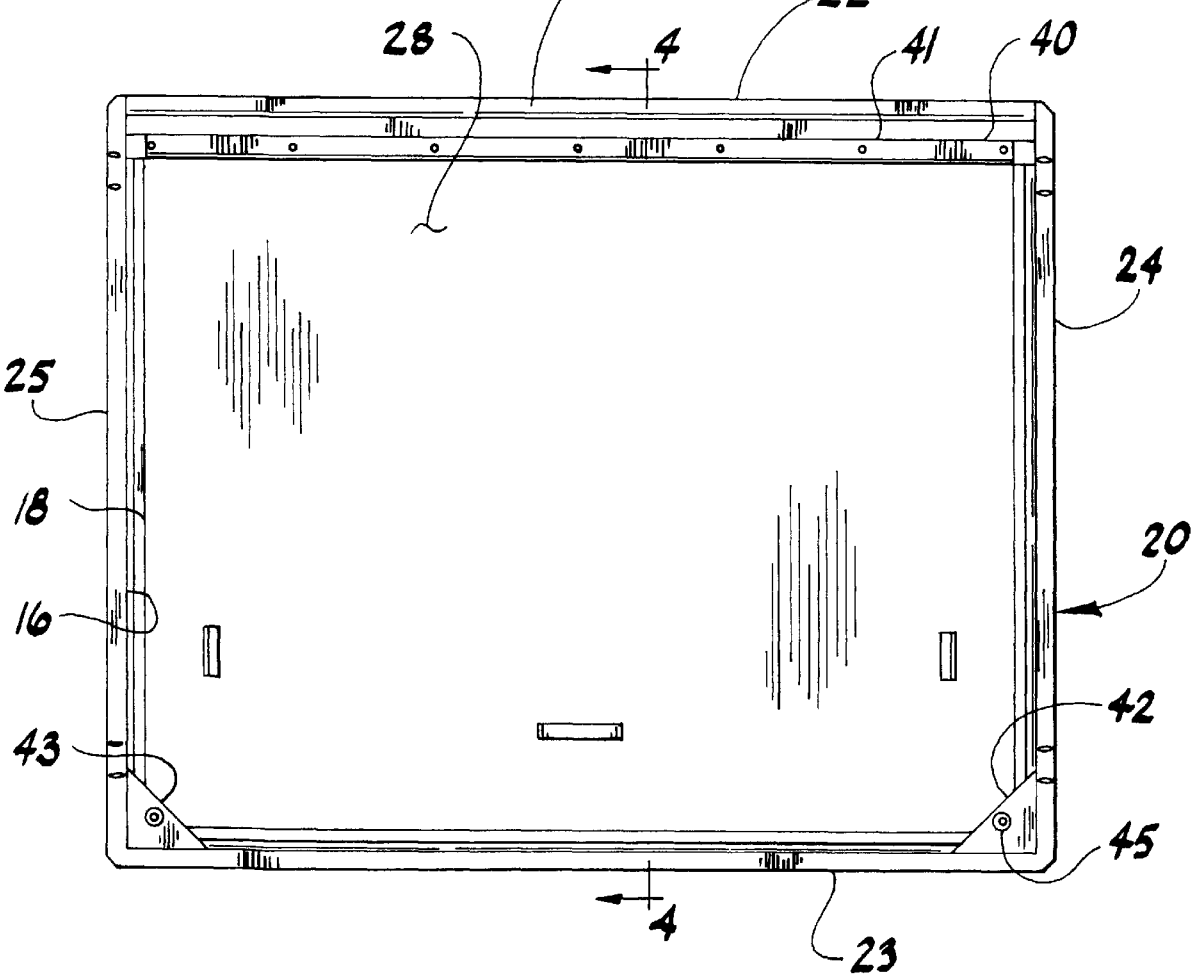
FIG. 3 is an enlarged front elevation of the door.

Preferably, a seal 36, such as the rubber "D" seal shown in FIG. 4, is attached to the reinforcing box beams 29 at the periphery of the door 18 for sealingly engaging the bottom frame member 23 and the right and left side frame members 24, 25 of the frame 20 to seal against the passage of air through the opening 16 when the door 18 is in its closed position. A skirt 38 is attached to the main panel portion 28 at the top edge of the door 18 and extends substantially parallel to the top frame member 22 along substantially its full length. The skirt 38 is preferably made of neoprene and is attached by a retainer in the form of a steel channel 40 secured by screws 41 extending through the channel, skirt and into the door 18. As shown in FIG. 4, the skirt 38 is shaped to engage the top frame member 22 when the door 14 is in its closed position to further seal the opening 16. Preferably, a right corner piece 42 and a left corner piece 43 are mounted on adjacent corners of the door 18 for frictional, sealing engagement with the frame 20. As shown, the right and left corner pieces 42, 43 are attached, as by screws 45, near the bottom corners of the door to engage the right and left frame members 24, 25, respectively, and the bottom frame member 23. The right and left corner pieces 42, 43 help to seal the opening 16 at the bottom corners where the seal 36 may leave gaps. The right and left corner pieces 42, 43 are preferably relatively stiff and are made of thick rubber or other suitable material. The seal 36 and the corner pieces 42, 43 frictionally engage the frame members 22–25 to hold the door 18 closed under most circumstances. When the door 18 is subjected to substantial air pressure, such as concussive air from a mine blast or longwalling cave-in, the air pressure will overcome the friction between the seal 36 and corner pieces 42, 43 and the frame members 22–25 to force the door to an open position. Moreover, the air pressure may force the door 18 to swing in either direction to its first or second open position. The ability of the door 18 to swing in both directions is advantageous. Whenever a large, abrupt air displacement occurs, such as occurs in longwall mining or in a mine blast, there is an initial expansion or push of concussive air in a direction away from the displacement, followed by a pulling of air in the opposite direction toward the displacement as the low pressure on the displacement side of the stopping 10 is equalized with the higher pressure on the other side of the stopping. The construction of the swinging door 18, as described above, allows the air flow caused by the displacement to pass through the opening 16 in both directions.

Figure 5:
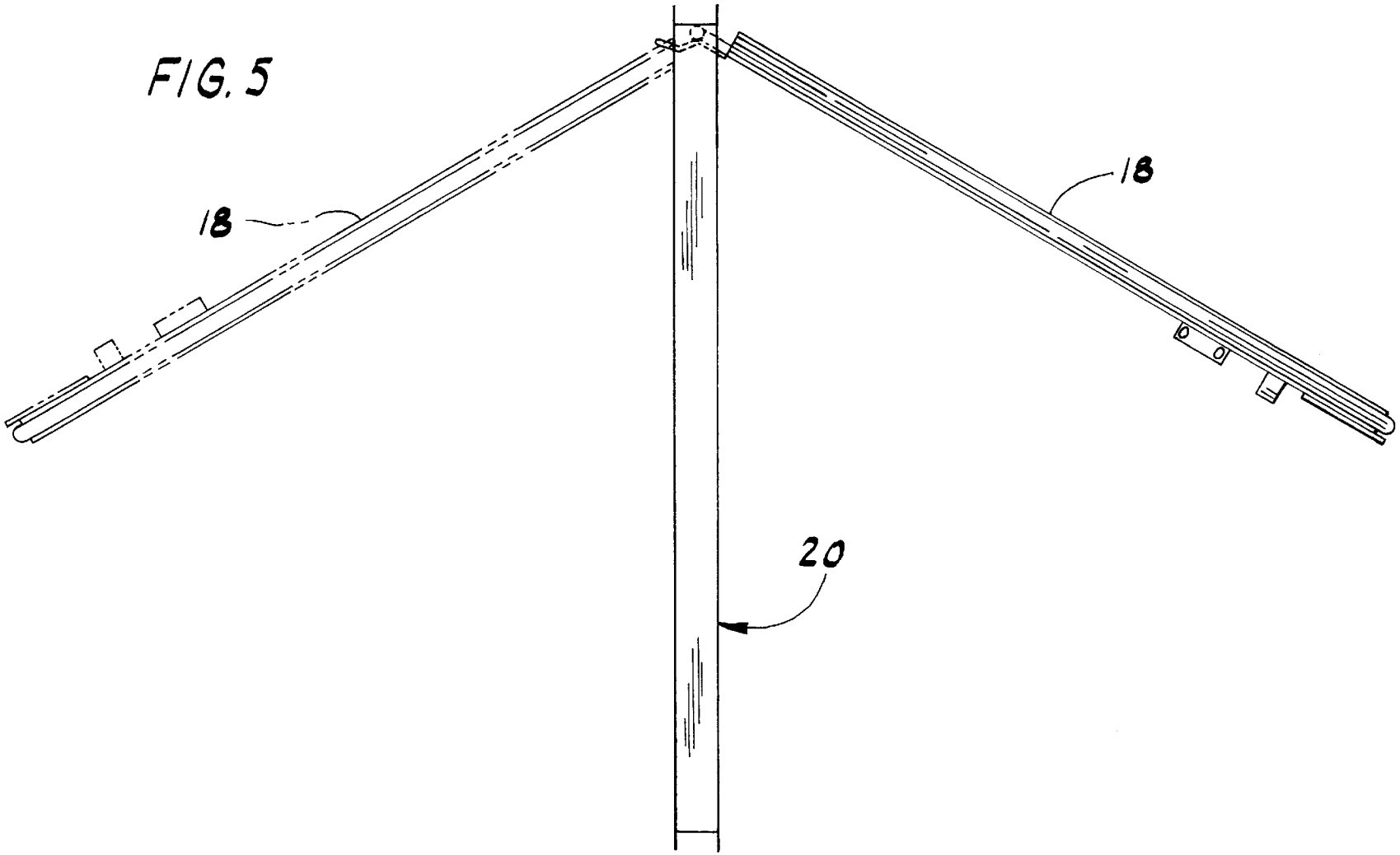
FIG. 5 is a side elevation showing the door in a first open position with respect to a door frame, the door being shown in phantom lines in a second open position.
Figure 7:
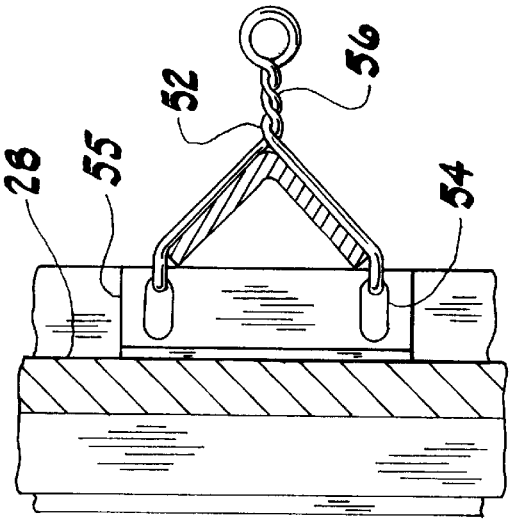
FIG. 7 is an enlarged vertical cross section taken in the plane of line 7—7 of FIG. 6.
Figure 6:
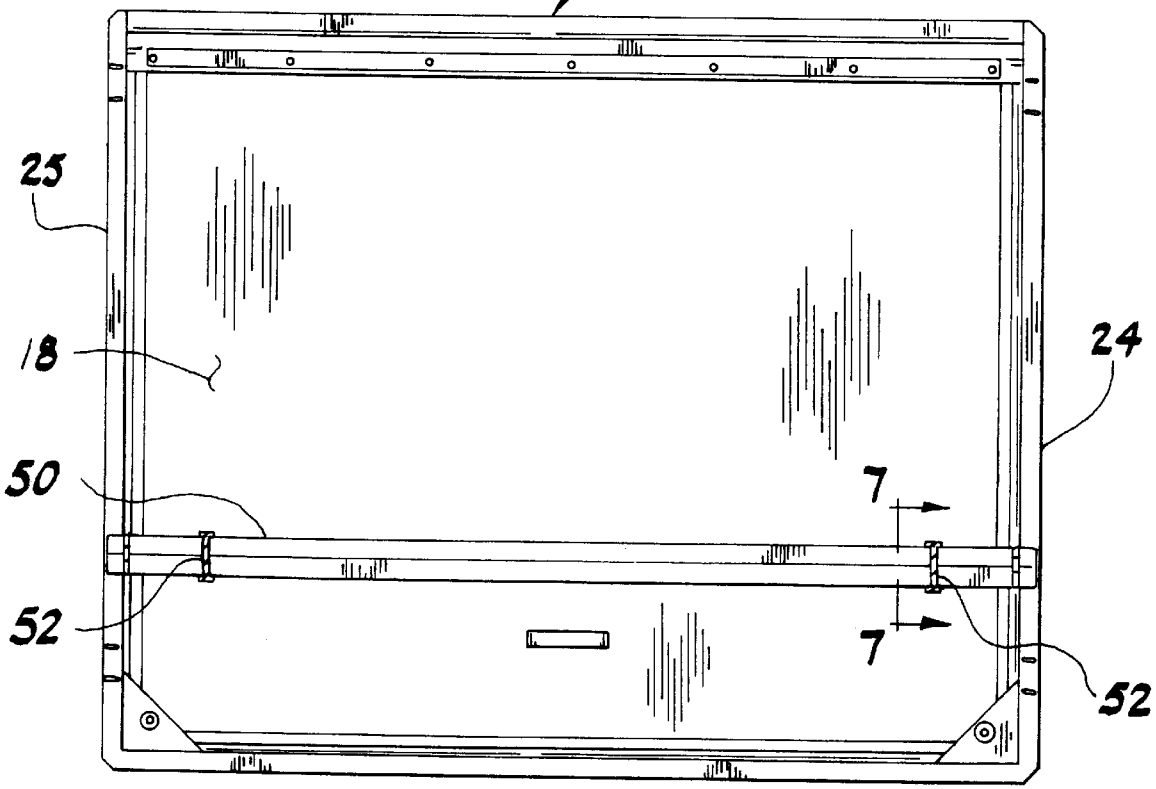
FIG. 6 is an enlarged front elevation of the swinging door with a locking bar mounted thereon.

Referring to FIGS. 6 and 7, the mine stopping 10 preferably includes a mechanism for maintaining the door 18 in its closed position. In this embodiment, the mechanism includes an elongate locking bar 50 releasably mounted on the door 18 in a locking position in which the bar extends laterally beyond the door for engagement with the door frame 20 to prevent the door from moving toward either of its first or second open positions. As shown in FIG. 5, the bar 50 is secured to both the right and left frame members 24, 25, although securement to only one frame member is contemplated. Preferably, the locking bar 50 is removably mounted on the door 18 by a plurality of generally U-shaped wire ties 52 (also referred to as twist clamps), each tie having a hook 54 at each end engageable with a slot of a bracket 55 affixed to the door, and a central portion 56 adapted to be twisted so as to deform the wire tie around the bar to hold the bar in engagement with the door. The bar 50 is similarly attached to the right and left frame members 24, 25 by wire ties 52 engageable with slots (not shown) in the frame members, the arrangement operable to prevent the door from swinging in either direction to an open position. The bar 50 is easily removable from its locking position simply by removing the wire ties 52. It is to be understood that other mechanisms for maintaining the door closed may be used within the scope of this invention.

Referring again to FIGS. 1 and 2, the mine stopping 10 includes the rigid wall 12 extending across the passageway 14. The wall 12 preferably includes a first section 62 extending between the opening 16 and one side of the passageway, and a second section 63 extending between the opening and the opposite side of the passageway. At least one of the two sections 62, 63 extends at an oblique angle A (see FIG. 2) with respect to the direction of air flow through the passageway 14. In the preferred embodiment, both sections 62, 63 extend at an oblique angle with respect to the direction of flow. It should be apparent that the direction of air flow is generally parallel to the walls of the passageway 14 adjacent the stopping 10. Conventional prior stoppings are installed perpendicular to the flow of air, which causes the stopping to experience the full amount of velocity pressure caused by the flow. (Note that static pressure is neglected in this discussion.) In the present invention, the angling of the wall 12 reduces the velocity pressure exerted against the stopping by a factor of the sine of the angle between the direction of flow and the wall. In the prior stoppings mentioned above, the angle between the direction of flow and the stopping is generally 90°. Since the sine of 90° is 1, the velocity pressure has its full impact on the stopping. In the present invention, as an example, the wall 12 may be constructed such that the angle A between the direction of flow and the wall is, for instance, 45°. Since the sine of 45° is 0.707, the velocity pressure impact on the door would be only 0.707 times the full velocity pressure.

The wall 12 may be constructed of a plurality of elongate extensible panels extending vertically in side-by-side relation from a floor to a roof of the passageway 14. The panels are preferably positioned substantially in a plane at an oblique angle with respect to the direction of air flow through the passageway 14. Installation of such panels is described in U.S. Pat. No. Re. 32,675, which is incorporated herein by reference, and suitable panels are available from Jack Kennedy Metal Products, Taylorville, Ill. The wall may also be constructed of masonry blocks or other similar materials.

It is to be understood that the stopping 10 with angled wall sections 62, 63 may be constructed without a door or other structure to close the opening 16. It should also be understood that the opening 16 may be positioned immediately adjacent the passageway 14, i.e., the wall 12 may consist of only one section extending from one side of the passageway to an opening at the other side of the passageway, the opening being defined in part by the passageway and in part by the stopping 10.

Figure 8:
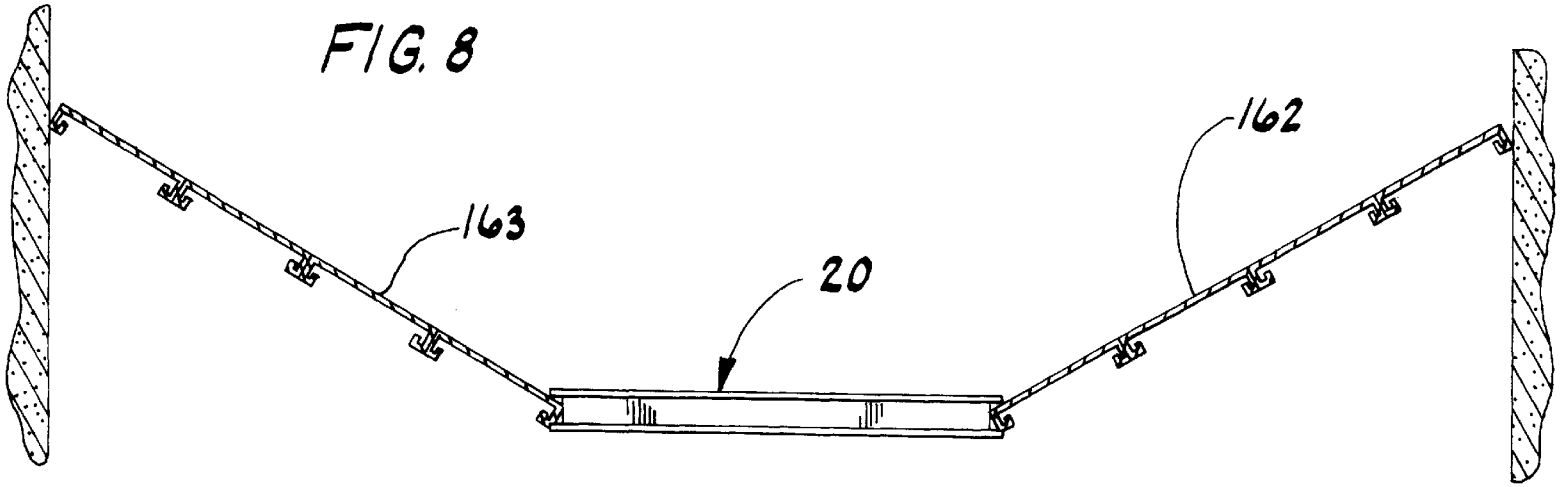
FIG. 8 is a horizontal cross section like FIG. 2 showing a second embodiment of the invention.

FIG. 8 shows a second embodiment wherein the wall sections 162, 163 are oriented more than ninety degrees relative to the direction of air flow shown. However, as noted above, the direction of air flow in a mine passageway 14 is reversible. Thus, the angled wall sections may be angled more than ninety degrees relative to one direction of air flow, and may be angled at less than ninety degrees to flow in the opposite direction, but preferably the wall sections will generally be oblique to the direction of air flow. Moreover, as shown in FIG. 8, the wall sections 162, 163 may be angled at a shallower angle than in the first embodiment, such as about 30 degrees. The wall sections may also be angled at angles greater than those shown. The exact angle of the wall may depend upon such factors as the expected direction of air flow, or the length of the mine passageway in which the stopping is installed. The preferred angle for most stoppings is in the range of 40–50 degrees.

The sloped stopping 10 is advantageous as described above because it reduces the velocity pressure against the stopping.

It is further advantageous in that it directs the air flow more satisfactorily toward the doorway or opening 16 in the stopping. This is accomplished because the sloped stopping acts as a funnel to direct the air flow toward the opening. This feature helps to improve the ventilation of the mine in that it allows air to flow more rapidly and efficiently through the stopping.

Figure 9:
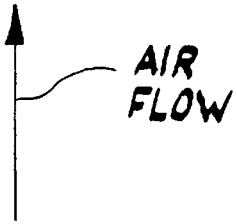
FIG. 9 is a horizontal cross section like FIG. 2 showing a third embodiment of the invention.
Figure 9:
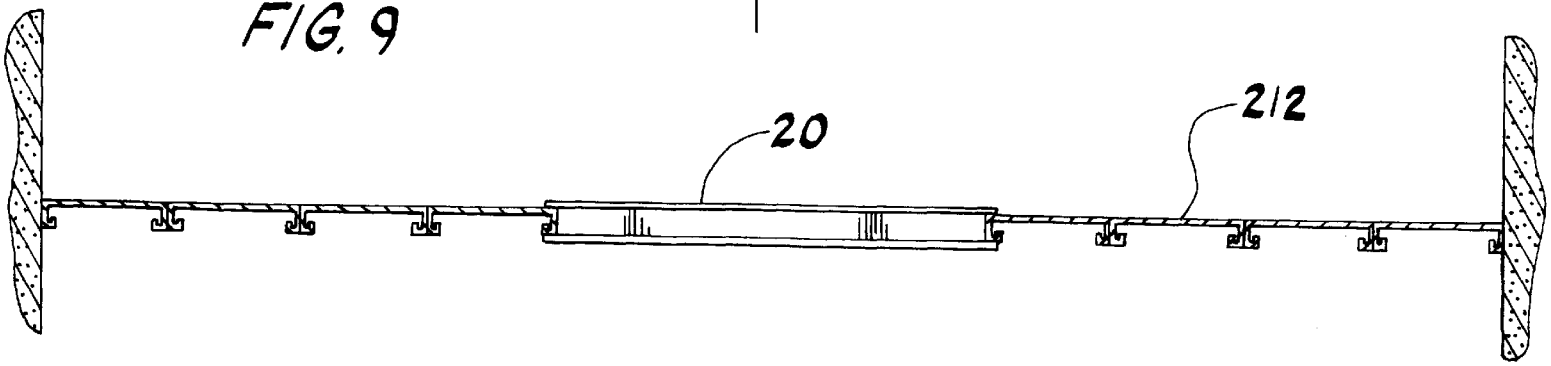

Referring to FIG. 9, in a less preferred embodiment, the swinging door and frame 20 of the first embodiment is shown installed in a conventional stopping 212 having walls installed perpendicular to the direction of air flow. Thus, the swinging door of this invention may be used advantageously in any mine stopping, and is not limited to use in the angled stopping of this invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A mine stopping comprising:

a wall extending across a passageway in a mine to close the passageway, said wall having inwardly facing surfaces defining an opening therein, and a door hinged adjacent the opening for swinging between a closed position in which the door closes the opening to inhibit the passage of air therethrough, a first open position in which the door is swung in one direction away from said closed position, and a second open position in which the door is swung in an opposite direction away from said closed position, said door being movable to either of its said first and second open positions when subjected to substantial concussive air pressure thereby to permit concussive air to pass through the opening in both directions and thereby relieve said concussive air pressure.

2. A mine stopping as set forth in claim 1 further comprising a seal at the periphery of the door extending generally parallel to a plane of a face of the door and engaging said inwardly facing surfaces defining the opening when the door is in its said closed position for sealing against the passage of air past the door when the door is in its said closed position.

3. A mine stopping as set forth in claim 2 wherein the opening is defined by a rectangular door frame mounted in the opening, and said door is hinged on the door frame, said seal being attached to the door and being sealingly engageable with the door frame when the door is in said closed position substantially to prevent passage of air through the opening, said seal being movable out of engagement with the door frame as the door moves to its first and second open positions.

4. A mine stopping as set forth in claim 3 wherein said seal extends from edges of the door for said sealing engagement with the door frame when the door is in said closed position.

5. A mine stopping as set forth in claim 4 wherein said seal further comprises corner pieces mounted on adjacent corners of the door for frictional, sealing engagement with said door frame when the door is in said closed position.

6. A mine stopping as set forth in claim 1 further comprising a mechanism for maintaining the door in said closed position.

7. A mine stopping as set forth in claim 6 wherein said mechanism includes a bar releasably mounted on the door in a position in which the bar extends laterally beyond the door for securement to the door frame to prevent the door from moving toward its said first or second open positions.

8. A mine stopping as set forth in claim 1 wherein said wall comprises a plurality of elongate extensible panels extending vertically in side-by-side relation from a floor to a roof of the passageway.

9. A swinging door system for closing an opening in a mine stopping, said swinging door system comprising:

a door hinged adjacent the opening for swinging between a closed position in which the door closes the opening to inhibit the passage of air therethrough, a first open position in which the door is swung in one direction away from said closed position, and a second open position in which the door is swung in an opposite direction away from said closed position, said door being movable to either of its said first and second open positions when subjected to substantial concussive air pressure thereby to permit concussive air to pass through the opening in both directions and thereby relieve said concussive air pressure.

10. A mine stopping as set forth in claim 9 further comprising a seal at the periphery of the door for sealing against the passage of air past the door when the door is in its said closed position.

11. A mine stopping as set forth in claim 10 wherein the opening is defined by a rectangular door frame mounted in the opening, and said door is hinged on the door frame, said seal being attached to the door and being sealingly engageable with the door frame when the door is in said closed position substantially to prevent passage of air through the opening, said seal being movable out of engagement with the door frame as the door moves to its first and second open positions.

12. A mine stopping as set forth in claim 11 wherein said seal extends from edges of the door for said sealing engagement with the door frame when the door is in said closed position.

* * * * *